United States Patent [19]

Samuelsen

[11] Patent Number: 4,461,668

[45] Date of Patent: Jul. 24, 1984

[54] DISPENSER FOR DISPENSING A LAMINATED WEB

[75] Inventor: Peter Samuelsen, Rungsted Kyst, Denmark

[73] Assignee: Coloplast A/S, Espergaerde, Denmark

[21] Appl. No.: 420,765

[22] Filed: Sep. 21, 1982

[30] Foreign Application Priority Data

Sep. 23, 1981 [DK] Denmark ..... 4206/81

[51] Int. Cl.[3] ..... B32B 31/04

[52] U.S. Cl. ..... 156/543; 156/579

[58] Field of Search ..... 156/523, 527, 577, 584, 156/576, 554; 225/34–38

[56] References Cited

U.S. PATENT DOCUMENTS

| | | | |
|---|---|---|---|
| 2,608,503 | 8/1952 | Meyer | 156/554 X |
| 2,625,200 | 1/1953 | Hirszson | 156/555 |
| 3,536,569 | 10/1970 | Gosnell | 156/527 |
| 3,586,587 | 6/1971 | Boyce | 156/527 |

FOREIGN PATENT DOCUMENTS 2501586 7/1976 Fed. Rep. of Germany .

*Primary Examiner*—David A. Simmons

*Attorney, Agent, or Firm*—Lawrence Rosen

[57] ABSTRACT

A dispenser for dispensing a laminated web (24) comprising a flexible, adhesive layer (12) having a certain thickness surrounded by a first and a second relatively stiff protective sheet (14,18). The dispenser comprises a holder, e.g. a housing (2), for a first roll (4) and a second roll (8) with a press slot (16) serving as an outlet guide means. The rolls and the press slots are arranged to permit simultaneous moving of a first web (5) comprising the adhesive layer (12) and the first protective sheet (14), and a second web consisting of the second protective sheet (18) from the first and the second rolls, respectively, and through the press slot.

The dispenser permits dispensing of the laminated web, although the web cannot be stored as a roll.

2 Claims, 6 Drawing Figures

DISPENSER FOR DISPENSING A LAMINATED WEB

Figure 1:
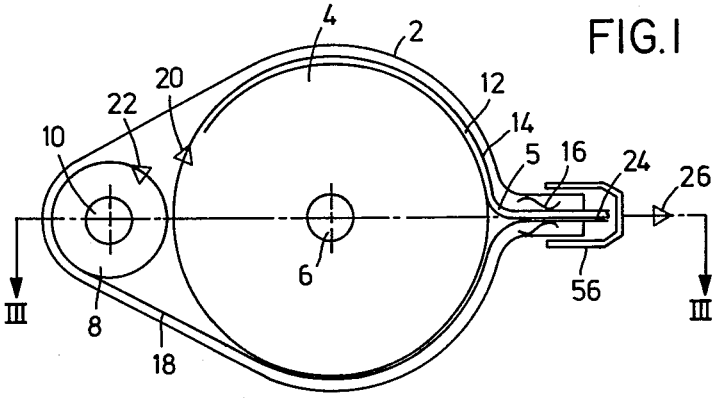

The present invention relates to a dispenser for dispensing a laminated web comprising a double-faced adhesive layer and two protective sheets from a roll, which dispenser comprises a holder for the roll and an outlet guide means. Such laminated webs are, for example, usable as dressing or bandage.

The storage of the double-faced adhesive tape as a roll is known, e.g. using a dispenser of the above-mentioned type. The storage of the double-faced adhesive tape as a roll depends on the provision of a protective sheet on both sides. Such protective sheets are normally, at least on one side, a crepe paper having the advantage of being able to be wound without troubles together with the adhesive tape, the wrinkles provied by crimping the paper permitting an extension of the outer sheet of the crepe paper when wound.

As it will be explained below, the known dispenser is not usable for dispensing a laminated web if this comprises a flexible adhesive layer sandwiched between two relatively stiff protective sheets, such as the web including an adhesive layer for bandage or dressing of the type disclosed in the Danish patent application No. 5209/80, according to which the adhesive layer on one side may be coated with a water-impermeable sheet of co-laminated covering foil or sheet and stiff silicone paper, and may on the other side be provided with a protective sheet of stiff silicone paper. The two silicone papers are removed immediately before applying the adhesive layer on the skin of the patient.

The above-mentioned known adhesive layer for dressing or bandage application may be prepared as a flat laminated web, either by applying an adhesive substance on a smooth and stiff silicone paper and then laminating with another stiff silicone paper with covering foil, or by applying adhesive substance on a stiff silicone paper coated with covering foil and then laminating with silicone paper. In both cases the laminated web obtained causes trouble in practice. Thus, it is difficult to handle because it cannot be stored in the form of a roll. A web comprising a single relatively stiff sheet and a generally thicker, flexible layer does not give rise to any trouble if it is desired to wind the web into a roll. However, this is not the situation when the web is a composite web comprising a first relatively stiff sheet, a flexible layer, and a second relatively stiff sheet, because such composite web inevitably will form wrinkled or creased portions when the composite web is wound into a roll. This cannot be avoided because the two relatively stiff sheets will have a certain space, which means that the one of the stiff sheets being the outer one in the winding, will get a substantially larger radial distance from the axis of rotation of the roll and thereby a larger arc length as compared with the corresponding arc length of the inner stiff sheet. In this way the outer stiff sheet will be tight, whereas the inner stiff sheet cannot be tightened and becomes wrinkled.

Of course, the above problems could be solved if one of the stiff silicone papers was replaced by a crimped silicone paper. However, due to the rheological properties of the adhesive substance used, the side of the adhesive substance lying adjacent to the crepe paper will be formed to a corresponding relief pattern, whether the adhesive substance is applied on a crimped paper and then laminated with a stiff silicone paper with covering foil or whether it is appliced on the stiff silicone paper with covering foil and then laminated with crepe silicone paper. Firstly, such relief pattern will decrease the adhesivity of the adhesive layer and secondly it will give transverse channels in the adhesive layer, which will result in leakages when the adhesive layer is used as a bandage or dressing. Therefore, crimped silicone paper cannot be used in practice together with the laminated web disclosed in Danish patent application No. 5209/80.

European patent application No. 0 010 439 discloses a laminated structure which may be used as a dressing material or in baby linen, comprising a water-permeable facing sheet and a backing sheet having a liquid absorbing material distributed between the sheets, which material may as an example be a hydrocolloidal polymer which may have the property of acting as an adhesive when moistened with water. This laminated structure is prepared by pulling the one outer sheet from a first roll and the other outer sheet from a second roll towards a press slot. Before reaching this press slot one of the outer sheets is applied with the liquid absorbing material, which in this way will be sandwiched between the two outer sheets. Then the composite web is guided through the press slot, wherein it is embossed to a pattern, whereby only a partial, e.g. in points or lines, adhesion is obtained between the sheets. However, by such embossing the smooth structure is not maintained, and there will not be any problems if the obtained laminated structure is wound into a roll.

Thus the European patent application No. 0 010 439 does not suggest any practical handling of a laminated web comprising a flexible adhesive layer without the formation of wrinkles in the protective sheets, particularly when the web is composed of an adhesive layer having a certain thickness with relatively stiff protective sheets on both sides thereof, for example the skin plate disclosed in the above-mentioned Danish patent application No. 5209/80, where the adhesive layer must be protected during storage and until the time of usage, for example with paper sheets coated with silicone wax on the surfaces adjacent to the adhesive layer.

The object of the present invention is to provide a dispenser as mentioned above and by which it will be possible in a practical way to dispense a laminated web having the above-mentioned composition.

According to the invention this is possible by means of a dispenser wherein the holder in addition to means for holding said first roll is provided with means for holding a second roll, wherein the outlet guide means is a press slot, and wherein the relative location of the two rolls and the press slot permits the first web comprising the adhesive layer and one of the protective sheets, which is nonadhesive on the surface not adjacent to the adhesive layer and a second web consisting of a second protective sheet to be guided simultaneously from the first and the second rolls, respectively, and through the press slot.

With a dispenser of this kind it is possible to store a flexible adhesive layer in a protected way surrounded on both sides by the protective sheets in the same and the adjacent windings, respectively, in the roll. As there is only a single, relatively stiff protective sheet for each winding of the composite first web, no problem of wrinkling of the protective sheet occurs. Furthermore, the second protective sheet forming alone the second web wound on the second roll gives no wrinkling problems either. Thus, the desired laminated web may be pulled out from the dispenser through the press slot in a nice and smooth condition, for example immediately before use for bandage purpose.

In a particularly simple embodiment the press slot of the dispenser is provided between two opposite ribs. These ribs may provide an appropriately small degree of resistance against the movement of the laminated web. For example such movement may be obtained by manual force.

If a certain pressure is needed for combining the first and second webs to the laminated web, the press slot may be provided between two rollers with substantially parallel axes of rotation. Thereby a certain pressure may be obtained without a too high degree of resistance against the movement through the press slot. This movement may take place either manually or by addition of a drive force to one or both of the rollers.

In order to ensure that the two webs are pressed against each other with a pressure sufficient for obtaining the composite laminate web in a coherent condition, but on the other hand in such a way that it will not be too difficult to pull the laminated web out of the dispenser, the press slot may be provided with means making it possible to variate the pressure and/or the distance over the press slot.

In order to keep the second protective sheet fixed on the adhesive layer after the passage through the slot, it is advantageous to apply on the laminate web an appropriate pressure on both sides. This may be obtained by providing a number of ribs after the press slot as stated in claim 2.

In order to ensure that the second protective sheet and the composite web will be able to meet before the press slot without occurence of wrinkles during the combination to the laminated web, the press slot and the axes of rotation of the two rolls should be substantially parallel to each other, and they should preferably be situated in the same plane. To ensure that the unprotected surface of the adhesive layer is not uncovered until immediately before it meets the second protective sheet at the press slot, it is also advantageous if the roll of the composite first web is situated between the press slot and the second roll.

For the appropriate protection of the adhesive layer before dispensing the laminated web through the press slot the composite first web on the first roll should have its protective sheet situated on the outer side of the adhesive layer in each winding. In this way a further advantage is obtained because the protective sheet from the second roll on its way to the press slot may pass the first roll without directly contacting the adhesive layer.

For holding the rolls in proper place in the holder the first and, if desired, the second roll may be wound on a first and, if desired, a second storage spool, respectively. The spool or spools may be supported by suitable means in the holder. If at least the first roll is wound on a storage spool supported in the holder in the above-mentioned way, wherein the axes of rotation of the rolls and the press slot are substantially parallel and substantially in the same plane, and wherein the first storage spool with the first roll of the composite first web is situated between the press slot and the second roll, said first storage spool may advantageously be supported with an axis of rotation being displacable in said common plane, preferably in bearing means in the form of two opposite grooves in said plane. This ensures that the distance, wherein the adhesive layer is unprotected, will be as short as possible, because the first storage spool by pulling the laminated web out from the dispenser will be drawn towards the press slot, whereby the outer winding of the first roll always will be located immediately adjacent to the press slot.

To protect the sheets, layers and webs on the rolls against contamination and/or diffusion of components of the adhesive layer, the holder may advantageously be formed as a closed housing wherein the press slot preferably forms the sole opening. When the dispenser is not used, this opening may conveniently be covered by a removable closure.

Figure 2:
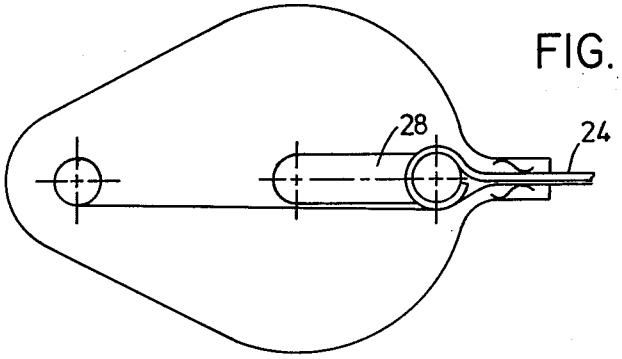
Figure 3:
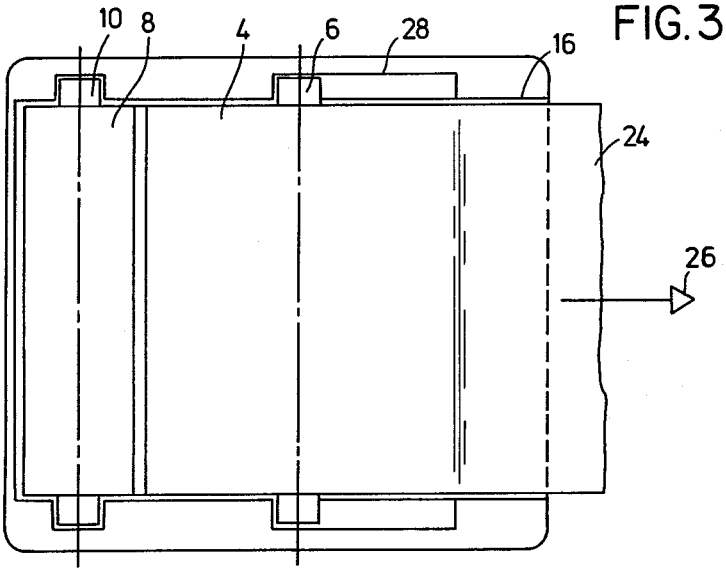
Figure 4:
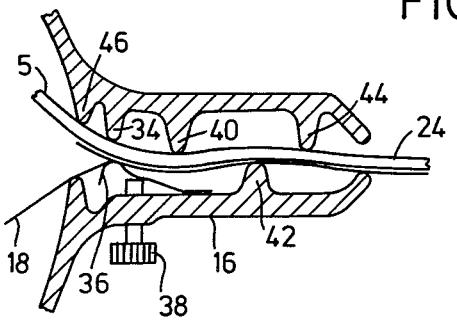
Figure 5:
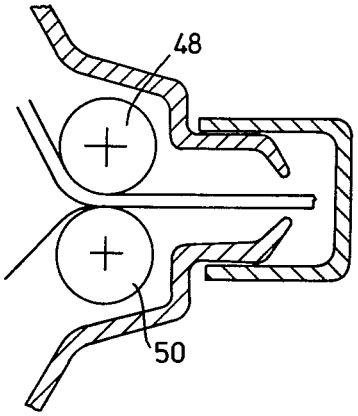
Figure 6:
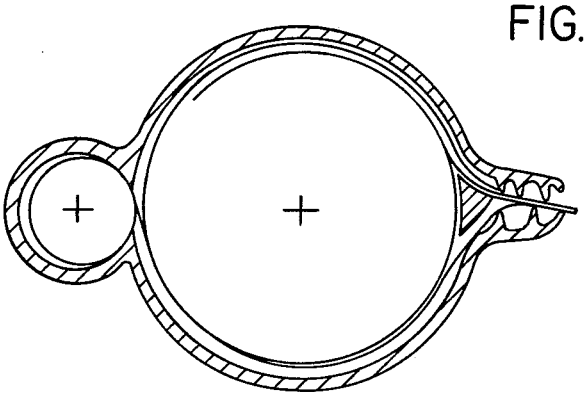

The dispenser according to the invention will now be further illustrated in connection with some embodiments and in connection with the drawing, in which:

FIG. 1 is a sectional view of a dispenser according to the invention in filled condition, FIG. 2 shows the dispenser of FIG. 1 in a condition, wherein it is nearly emptied, FIG. 3 is a cross-section along the line III—III in FIG. 1, FIG. 4 shows in details an embodiment of the press slot formed between a pair of ribs, FIG. 5 shows an alternative press slot formed by rollers, and FIG. 6 shows a dispenser having rolls without storage spools.

FIG. 1 shows a dispenser comprising a holder in the form of a housing 2, containing a first roll 4 on a first storage spool 6, and a second roll 8 on a second storage spool 10. The first roll 4 is provided of a composite web 5 consisting of a flexible adhesive layer 12 situated outermost in each winding, which protective sheet 14 on its outer surface, i.e. the surface turning outside and which may meet the adjacent adhesive layer, is non-adhesive, whereby the web 5 composed by the layer 12 and the sheet 14 can be pulled from the roll 14 through a press slot 16 together with a second web 18 from the roll 8. The second web 18 consists of a single protective sheet. In the embodiment shown on FIG. 1 this protective sheet 18 is pulled under the first roll 4, whereby the protective layer 18 slides against the the outer protective sheet 14 on the roll 4. The paths of the respective webs from the rolls 4 and 8 are marked with arrows 20 and 22, respectively. The composite laminated web 24 obtained after the passage through the press slot 16 can be drawn out from the dispenser in the direction of the arrow 26, e.g. by manual force.

In the embodiment shown the axes of rotation of the two storage spools 6 and 10 are parallel with the press slot 16 and they are situated in the same plane as the press slot. The first storage spool 6 with the first roll 4, from which the first composite web 5 can be pulled, is situated between the press slot 16 and the second storage spool 10 with the second roll 8. In this way the path from the location, wherein the flexible adhesive layer 12 is unprotected by the removal of the adjacent protective sheet 14 on the roll 4, to the location wherein it is covered again by a protective sheet, viz. the protective sheet 18, immediately before the press slot, will be as short as possible. In order to keep this distance as short as possible during the consumption of the roll 4, the first storage spool is in this embodiment supported on a parallel displaceable bearing means in the form of two grooves 28 as shown in FIG. 3. In this way the first storage spool 6 is displaced gradually towards the press slot 16 to the final position shown in FIG. 2.

In another alternative embodiment shown in FIG. 6, the holder 2 serves as a magazine for two loose rolls 4 and 8 with the first and the second web and without storage spools.

FIG. 4 shows an embodiment of the press slot 16 as two opposite ribs 34 and 36. The gab between these ribs may be adjusted with screws 38 for adjusting an appropriate pressure action depending on the thickness of the laminated web 24. After the press slot 16 are additional ribs 40,42,44 guiding the laminated web 24 and at the same time pressing it a little together, because the free gab between the ribs 40 and 44 at one side and the rib 42 at the other side is smaller than the thickness of the laminated web 24. A number of guiding ribs 46 for the two webs 5 and 18 are provided before the press slot 16.

FIG. 5 shows another embodiment of the press slot 16, wherein this is provided by means of two rollers 48,50. These rollers may be made of a flexible material in the peripherial area and/or their axes of rotation 52,54 may be supported in spring-loaded bearings (not shown). Thus, the pressure of the press slot may be adjusted by adjusting the distance between the bearings of the axes of rotation and/or by amending the spring load of the bearings. In this embodiment, wherein the press slot is provided by the rollers 48,50 the dispenser may be used in the same way as in the embodiment shown in FIG. 4, in which the press slot 16 is provided between two ribs 34,36, i.e. wherein the laminated web is pulled out through the press slot 16 by manual force. Alternatively, however, it is also possible to provide manual or mechanical driving means to one or both rollers 48,50.

When the dispenser has the form of a housing, wherein the press slot 16 is the sole opening, a loose removable closure 56 as shown in FIG. 1 or another closing means may be arranged to cover the opening.

I claim:

1. A dispenser comprising a housing; a first roll of a composite first web composed by a relatively thick flexible double-faced adhesive layer and a first relatively stiff protective sheet situated outermost in each winding of the roll, which first protective sheet is non-adhesive on at least its outermost surface; means affixed to said housing for holding said first roll; a second roll of a second web in the form of a second relatively stiff protective sheet; means affixed to said housing for holding said second roll; and outlet means forming an opening in the housing, through which the free ends of the first and second webs can be pulled together with the adhesive surface of the first web adjacent to the second web, the first and second webs forming together a laminated web comprising the adhesive layer sandwiched between the first and second protective sheets, said outlet means being press means for pressing the first and second webs against each other during their passage through the outlet means so that they adhere to each other.

2. A dispenser comprising a housing; a first roll of a composite first web composed by a relatively thick flexible double-faced adhesive layer and a first relatively stiff protective sheet situated outermost in each winding of the roll, which first protective sheet is non-adhesive on at least its outermost surface; means affixed to said housing for holding said first roll; a second roll of a second web in the form of a second relatively stiff protective sheet; means affixed to said housing for holding said second roll; and outlet means forming an opening in the housing, through which the free ends of the first and second webs can be pulled together with the adhesive surface of the first web adjacent to the second web, the first and second webs forming together a laminated web comprising the adhesive layer sandwiched between the first and second protective sheets, said outlet means being a press slot and one or more ribs parallel to the press slot and spaced in a staggered arrangement after the press slot on both sides of a path for the laminated web being formed, said ribs projecting so that they press against the laminated web forcing it to perform a slightly snake-like movement during their passage through the press slot.

* * * * *